US008056543B2

(12) United States Patent
Prior

(10) Patent No.: US 8,056,543 B2
(45) Date of Patent: Nov. 15, 2011

(54) TUNING DEVICE WITH COMBINED BACKFLOW FUNCTION

(75) Inventor: Gregory P. Prior, Birmingham, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 414 days.

(21) Appl. No.: 12/429,675

(22) Filed: Apr. 24, 2009

(65) Prior Publication Data

US 2010/0269797 A1 Oct. 28, 2010

(51) Int. Cl.

| | |
|---|---|
| ***F02B 33/00*** | (2006.01) |
| ***F02B 33/44*** | (2006.01) |
| ***F02B 37/00*** | (2006.01) |

(52) U.S. Cl. ..... 123/559.1; 60/598; 417/312; 417/452; 417/540; 417/542; 418/85; 418/139; 418/194; 418/201.1; 418/206.1; 138/26

(58) Field of Classification Search ..... 123/559.1; 418/85, 139, 194, 206.1, 201.1; 417/312, 417/540, 542, 452; 60/598; 138/26; *F02B 33/00, F02B 33/44, 37/00*

See application file for complete search history.

(56) References Cited

U.S. PATENT DOCUMENTS

| | | | | |
|---|---|---|---|---|
| 4,564,345 | A * | 1/1986 | Mueller | 418/206.5 |
| 4,609,335 | A * | 9/1986 | Uthoff, Jr. | 418/201.1 |
| 4,769,934 | A * | 9/1988 | Dolce | 40/789 |
| 6,589,034 | B2 * | 7/2003 | Vorwerk et al. | 418/15 |
| 6,874,486 | B2 | 4/2005 | Prior et al. | |
| 2003/0039568 | A1 * | 2/2003 | Vorwerk et al. | 418/15 |
| 2005/0150718 | A1 | 7/2005 | Knight et al. | |
| 2008/0060622 | A1 * | 3/2008 | Prior | 123/559.1 |
| 2008/0168961 | A1 | 7/2008 | Prior et al. | |
| 2008/0170958 | A1 | 7/2008 | Prior et al. | |
| 2010/0269797 | A1 * | 10/2010 | Prior | 123/559.1 |

* cited by examiner

*Primary Examiner* — Quyen Leung
*Assistant Examiner* — John K Kim
(74) *Attorney, Agent, or Firm* — Cantor Colburn LLP

(57) ABSTRACT

A supercharger has an inner wall defining an inner cavity for receiving lobed rotors for rotation therein, a low-pressure inlet and a high-pressure outlet. A sound attenuator is associated with the housing and located adjacent to the high-pressure outlet. The sound attenuator has a tuner chamber and circumferentially spaced tuner ports fluidly connecting the tuner chamber with the internal cavity of the housing to define a Helmholtz resonator. A land is defined between the circumferentially spaced tuner ports such that the high-pressure outlet and low-pressure inner chambers defined between the rotor lobes and the inner wall are fluidly connected when the rotor lobes are in alignment with the land to reduce the pressure differential between the high-pressure outlet and the low-pressure inner chambers.

12 Claims, 5 Drawing Sheets

TUNING DEVICE WITH COMBINED BACKFLOW FUNCTION

FIELD OF THE INVENTION

This invention relates to superchargers for internal combustion engines and, more particularly to superchargers having backflow ports for sound attenuation.

BACKGROUND OF THE INVENTION

Superchargers are used to pump air into an engine at a greater rate than natural aspiration. Combustion air enters the supercharger at nearly atmospheric pressure. Rotors in the supercharger carry nearly atmospheric air, via low-pressure internal chambers, to an outlet port where the air is pressurized for delivery to the cylinders of an associated engine. The discharge of the nearly atmospheric air into the pressurized outlet creates backflow noise in the form of a pneumatic report or pop. When repeated at the high frequency which is typical of supercharger operation, this series of reports becomes a whine that may be undesirable in an automotive application.

Fixed backflow ports in supercharger housings have been utilized to reduce supercharger generated sound by allowing a small amount of pressurized air to flow from the pressurized outlet of the supercharger into the nearly atmospheric low-pressure internal chambers. The backflow of pressurized air into the chambers tends to lower the pressure differential between the outlet and the low-pressure internal chambers gradually so that when the chambers exhaust into the higher pressure outlet, there is less energy in each pulse, thereby reducing sound generated by the pressure differential. However, fixed ports are operable to reduce supercharger noise across a small range of engine speeds and are limited to a reduction of supercharger sound generated by the introduction of low pressure air transported by the supercharger rotors to the higher pressure outlet.

Accordingly, it is desirable to provide a supercharger having backflow ports that operate to reduce supercharger generated noise across a broad operating range of the supercharger.

SUMMARY OF THE INVENTION

In one exemplary embodiment of the present invention a supercharger comprises a housing having a low-pressure inlet opening, a high-pressure outlet opening and an inner cavity having a plurality of cylindrical cavity portions defined by circumferentially extending housing walls, extending within the housing and fluidly connecting the low-pressure inlet opening and the high-pressure outlet opening. A plurality of lobed rotors is disposed for rotation in the cylindrical cavity portions. The lobed rotors have lobes configured to define, with the circumferentially extending walls of the cylindrical cavity portions, a plurality of low pressure internal chambers configured to move low pressure air from the low-pressure inlet opening to the high pressure outlet opening during rotation thereof. A sound attenuator is associated with the housing and is located adjacent to the high-pressure outlet opening, to define tuner chamber therein. A plurality of circumferentially spaced tuner ports, extending through the circumferentially extending walls of the cylindrical cavities, fluidly connects the tuner chamber of the sound attenuator with the internal cavity of the housing to define a Helmholtz-type resonator. At least one land is defined by the circumferentially extending walls of the cylindrical cavities, and extends between the circumferentially spaced tuner ports, such that the high pressure outlet opening and plurality of low pressure internal chambers are fluidly connected by the sound attenuator of the tuner chamber when the lobe of a lobed rotor defining a low pressure internal chamber is aligned with the land.

In another exemplary embodiment of the present invention a supercharger is provided comprising a housing having a low-pressure inlet opening, a high-pressure outlet opening and an inner cavity having a plurality of cylindrical cavity portions defined by circumferentially extending housing walls, extending within the housing and fluidly connecting the low pressure inlet opening and the high pressure outlet opening. A plurality of lobed rotors each has a plurality of radially extending lobes and is disposed for rotation in a cylindrical cavity portion. A lobe apex extends radially from each of the radially extending lobes to terminate adjacent the circumferentially extending walls of the cylindrical cavity portions to define a plurality of low pressure inner chambers between the lobes and the circumferentially extending walls. The low pressure inner chambers are configured to move air from the low pressure inlet to the high pressure outlet during rotation of the lobed rotors. A sound attenuator is associated with the housing and is located adjacent to the high pressure outlet opening. The sound attenuator defines a tuner chamber having circumferentially spaced tuner ports fluidly connecting the tuner chamber with the inner cavity of the housing, through the circumferentially extending walls of the cylindrical cavity portions, such that the sound attenuator and tuner ports define a Helmholtz resonator. At least one land defined by the circumferentially extending walls extends between the circumferentially spaced tuner ports and operates to fluidly connect the high pressure outlet opening and the inner chambers when the lobe apexes are aligned with the lands to reduce the pressure differential between the high pressure outlet opening and the inner chambers and reduce noise generated by the supercharger.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
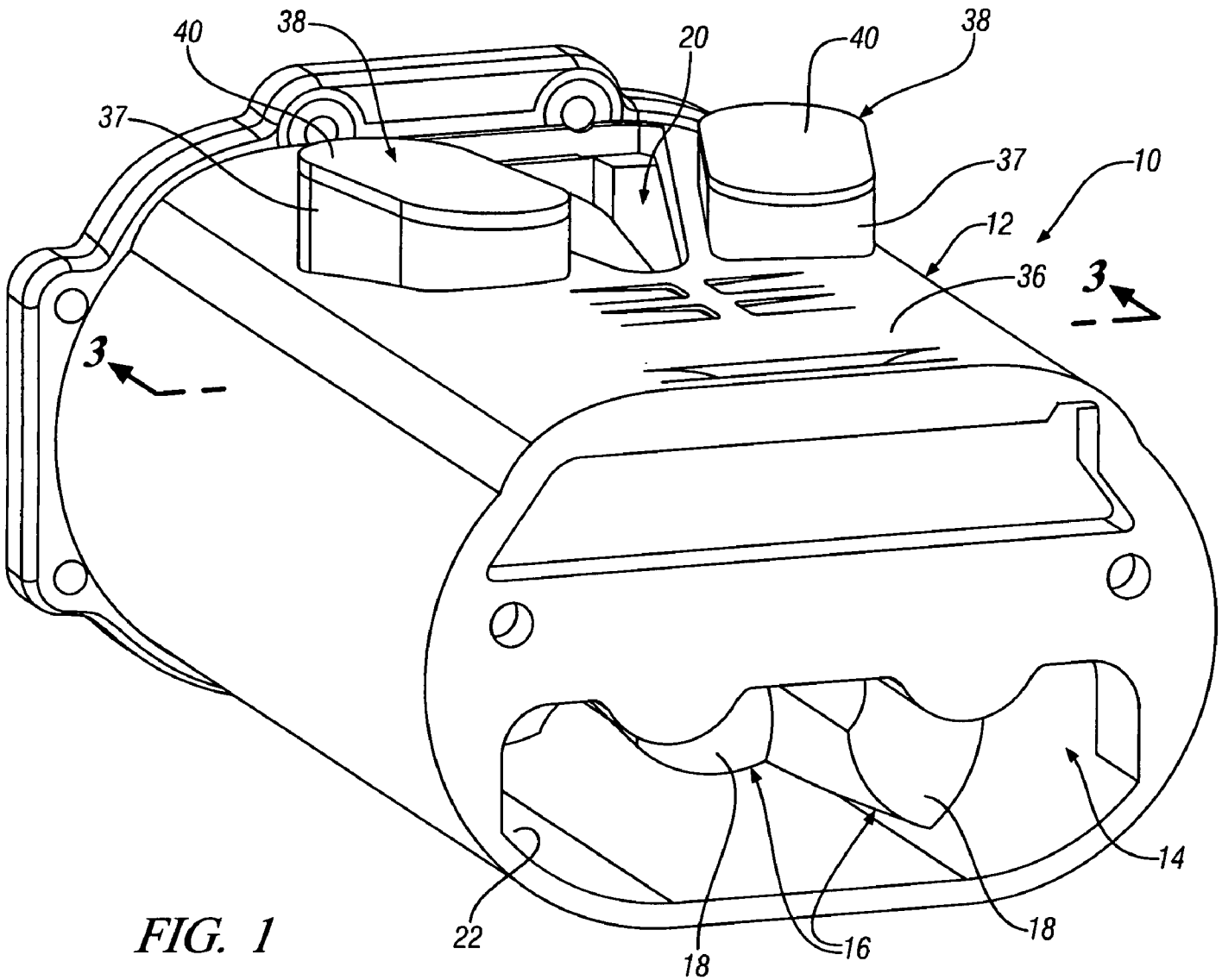
FIG. 1 is a perspective view a supercharger, viewed from the inlet end, embodying aspects of the invention.

In accordance with an exemplary embodiment of the present invention, FIG. 1 illustrates a Roots-type engine supercharger 10 having back flow ports for the reduction of supercharger generated sound. Supercharger 10 comprises a housing 12 having an inner cavity 14, that includes adjoining, overlapping, partially cylindrical cavity portions 15 defined by circumferentially extending housing walls 28, in which lobed rotors 16 are interleaved and are rotatable in opposite directions as indicated by the arrows in FIGS. 3-5. The lobes 18 of the lobed rotors 16 preferably have a helical twist as they extend longitudinally in the housing 12 in order to provide a relatively smooth discharge of air from high-pressure outlet opening 20. In alternative embodiments, such superchargers may also be constructed with other rotor configurations such as straight rotors with two or more lobes or screw-type rotors.

Supercharger housing 12 includes a low-pressure inlet opening 22 at one end of the housing, although such an opening may be provided on the lower side of the housing, if desired, for a particular application. A high-pressure outlet opening 20 is provided adjacent the opposite end of the housing 12. The high-pressure outlet opening 20 may be triangular in shape and, in the non-limiting embodiment shown, discharges air drawn in through the low-pressure inlet opening 22 to the intake manifold of an associated engine (not shown) through the upper side of the housing 12. The sides of the outlet opening 20 are angled to generally match the helical angles of the rotor lobes 18.

Figure 3:
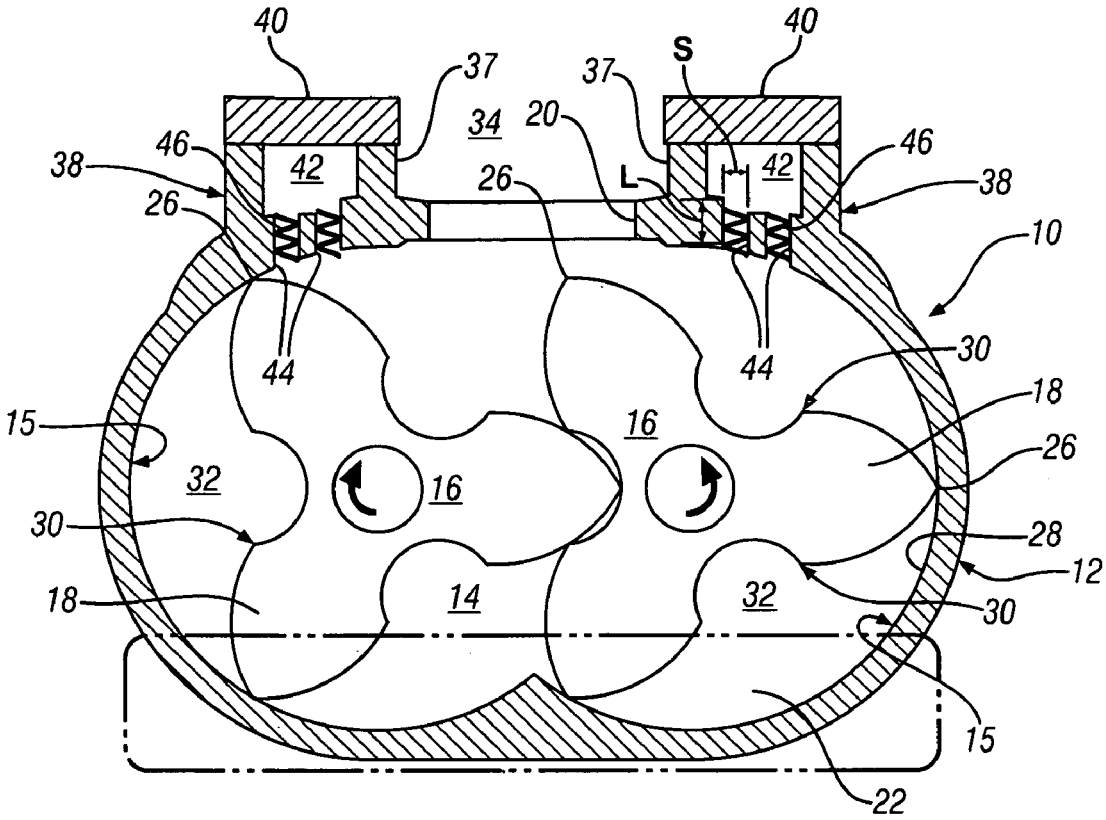
FIGS. 3-5 are partial sectional views of the supercharger of FIG. 1 taken along line 3-3 illustrating different modes of operation.
Figure 4:
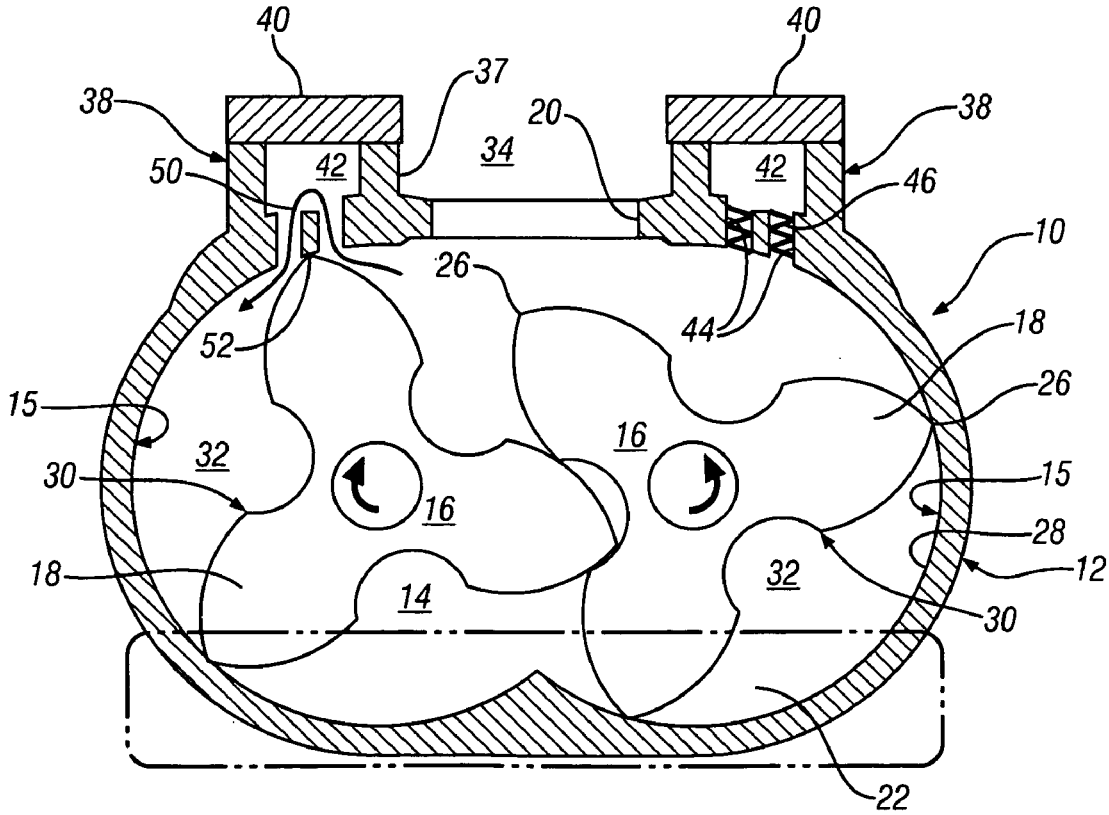
Figure 5:
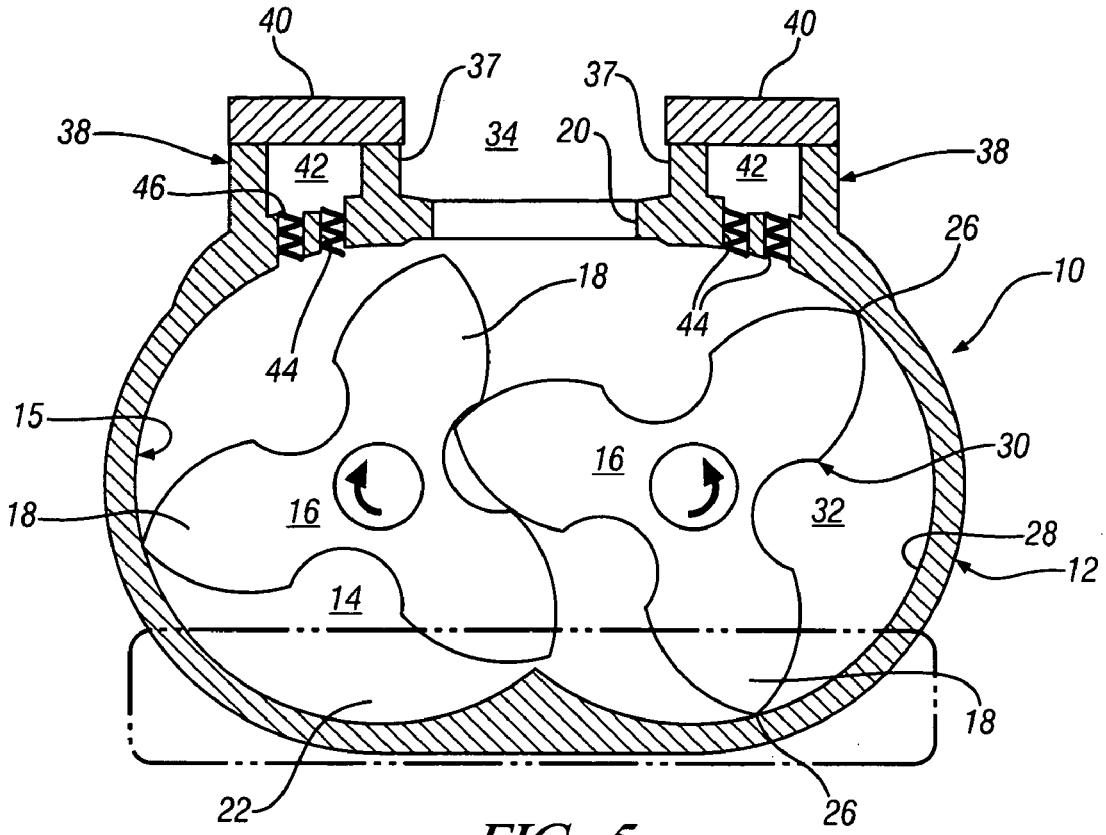

The rotor lobes 18 have apexes 26 that extend radially to terminate adjacent the circumferentially extending walls 28 of the cylindrical cavity portions 15, FIGS. 3-5. The apexes 26 may comprise the radially distal end of the lobes 18 or may include a separate sealing member (not shown). The lobes 18 and lobe apexes 26 rotate in close sealing relationship with the circumferentially extending walls 28 of the cylindrical cavity portions 15. Lobe recesses 30, extending between the lobes 18 define, with the circumferentially extending walls 28 of the cylindrical cavity portions 15, low-pressure internal chambers 32 that move circumferentially about the cylindrical cavity portions to move air at near atmospheric pressure from the low-pressure inlet opening 22 of the supercharger housing 12 to the high-pressure outlet opening 20, thereof In operation, the rotors 16 of the supercharger 10 are driven through a mechanical connection (not shown) with the engine at a rotational speed that varies as a function of the speed of the engine. As the lobed rotors 16 rotate, ambient air is drawn in through the low-pressure inlet opening 22 of the supercharger housing 12 and into the low-pressure internal chambers 32 which are open to the lower portion of the housing 12. The low-pressure internal chambers 32 move circumferentially about the partially cylindrical cavity portions 15 as the lobe apexes 26 of the lobed rotors 16 circumferentially trace the circumferentially extending walls 28. Ambient air is thus moved circumferentially about the periphery of each partially cylindrical cavity portion 15 of internal cavity 14 and is discharged through the hi-pressure outlet opening 20 to the high pressure plenum 34. The high pressure plenum 34 is pressurized during operation of the engine as the supercharger 10 is configured to deliver a greater volume of ambient air to the plenum 34 than can be drawn in by the naturally aspirated displacement of the associated engine. As a result, an outlet pressure from the supercharger 10 is developed so that the air is compressed sufficiently to allow it to enter the engine at the same rate as it is delivered by the supercharger 10, resulting in an associated boost pressure at the engine intake (not shown).

Figure 2:
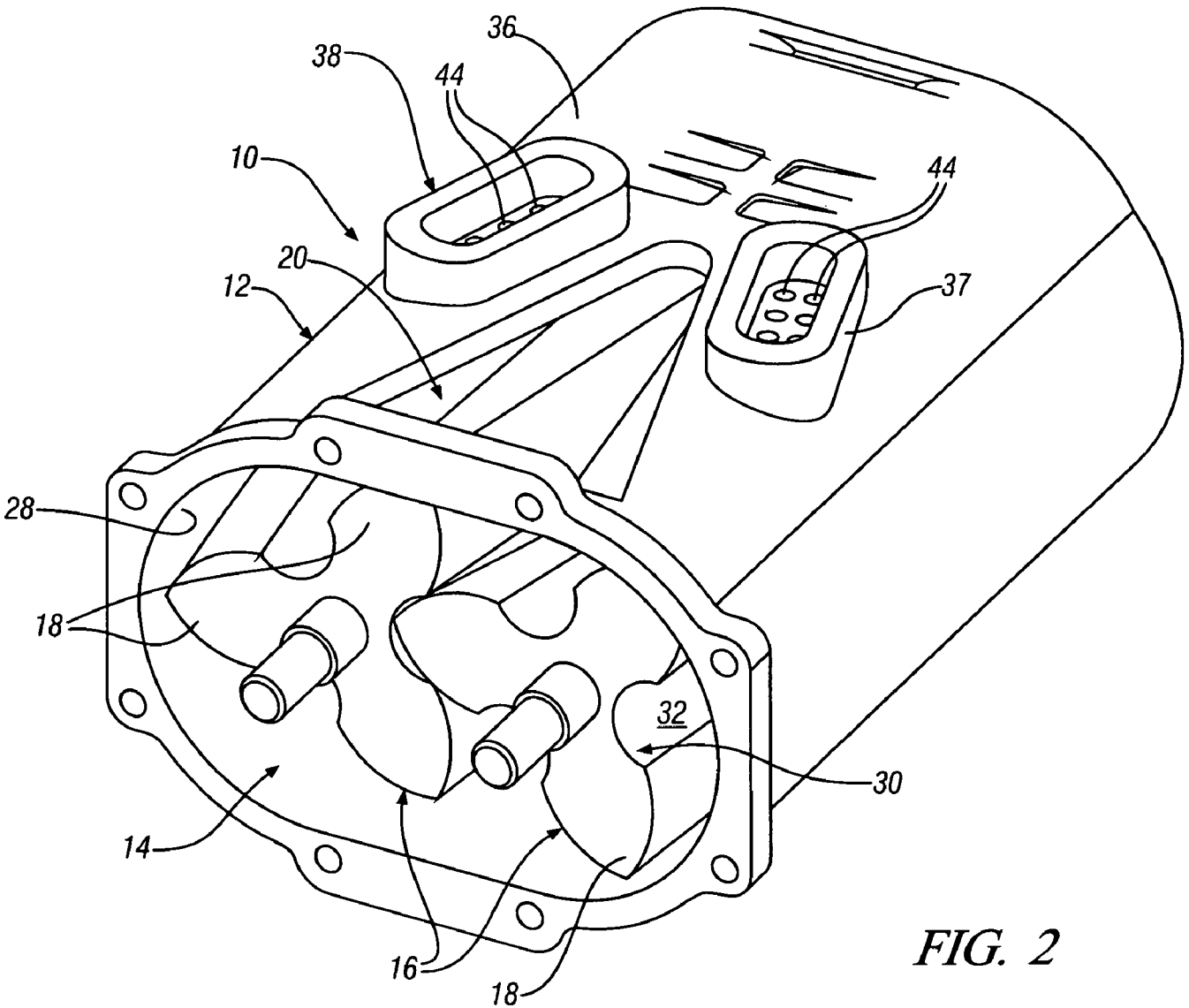
FIG. 2 is a perspective view of the supercharger of FIG. 1, viewed from the outlet end, with portions removed to illustrate added detail.

In a non-limiting embodiment, one or more sound attenuators 38 are disposed along the upper wall 36 of the supercharger housing 12. The sound attenuators 38 are located adjacent to the high-pressure outlet opening 20 of the of the supercharger housing 12 and, as illustrated in FIGS. 2-4 include sidewalls 37 extending from the housing and a closed upper portion or wall 40. The sidewalls 37 and upper wall or portion 40 define a tuner chamber 42 having a plurality of tuner necks or ports 44 which are circumferentially spaced about, and which open through, the circumferentially extending walls 28 of the cylindrical cavity portions 15 to fluidly connect an air mass in the tuner chamber 42 to the internal cavity 14. In one non-limiting embodiment illustrated in FIG. 2, two rows of tuner necks 44 extend generally longitudinally but are angled to align with the lobe apexes 26 of the lobes 18 so that the tuner ports 44 index, or align with the lobes 18 and the lobe apexes 26 at essentially the same rotational position of the rotor lobes 18.

During a first mode of operation of the supercharger 10, shown in FIG. 3, the necks or ports 44 have a length "L" and a diameter "S" (defining a port cross-sectional area and a volume) and operate with the associated tuner chamber 42 of the sound attenuator 38 to define a Helmholtz-type resonator. An air mass in each port 44 oscillates, as illustrated by the wave forms 46, as a result of sound impulses within the inner cavity 14 and plenum 34 of the supercharger housing 12. An associated, adjacent air mass in the tuner chamber 42 functions as a spring mass to effectively damp the wave form 46 to thereby attenuate sound caused by the pressure pulsations within the plenum 34 and internal cavity 14. The sound frequency (or frequencies) attenuated by the Helmholtz resonator is determined by the air volume (air mass) of the tuner chamber, by the number of tuner necks or ports 44, and by the length "L" and/or the cross-sectional area "S" (defining a port cross-sectional area and a volume) of the ports 44. As a result the Helmholtz resonators may be tuned to address desired sound frequencies.

During a second mode of operation of the supercharger 10, shown in FIG. 4, the circumferential spacing of the tuner necks or ports 44 along the circumferentially extending walls 28 of the cylindrical cavity portions 15, allows the tuner chambers 42 of the sound attenuators 38 to function as back flow ports that operate to reduce noise by allowing pressurized air 50, from the high-pressure outlet and plenum 34 to flow into the nearly atmospheric low-pressure internal chambers 32 as the lobe apexes 26 align with the land 52 located between the circumferentially spaced tuner necks or ports 44 during rotation of the lobed rotors 16. The shunting of pressurized air 50 through the internal chambers 32 tends to lower the pressure differential between the high pressure outlet opening 20 and the low-pressure internal chambers 32 gradually so that when the internal chambers 32 exhaust to the high pressure outlet opening 20 and the plenum 34, the energy in each pulse is reduced, thereby reducing the resultant noise. The level of pressure equalization may be modified or adjusted by adjusting the circumferential length of the land 52 or, more specifically, by adjusting the circumferential spacing between the tuner necks or ports 44 to increase or decrease the resident time of the lobe apexes 26 with the lands 52. As a result the energy available to produce the "pop" or "report" as each low-pressure internal chamber 32 opens into the high-pressure plenum 34 may be adjusted. Additionally, while illustrated as circular in the figures, the tuner necks or ports 44 may include a number of different shapes such as oval, slotted oblong or other suitable configuration which may be selected to provide appropriate sound reduction when operating as a Helmholtz-type resonator or as a differential pressure reducer. Once a lobe 18 has moved circumferentially beyond the series of circumferentially spaced tuner necks or ports 44, the Helmholtz-type resonator will begin functioning as described.

Figure 6:
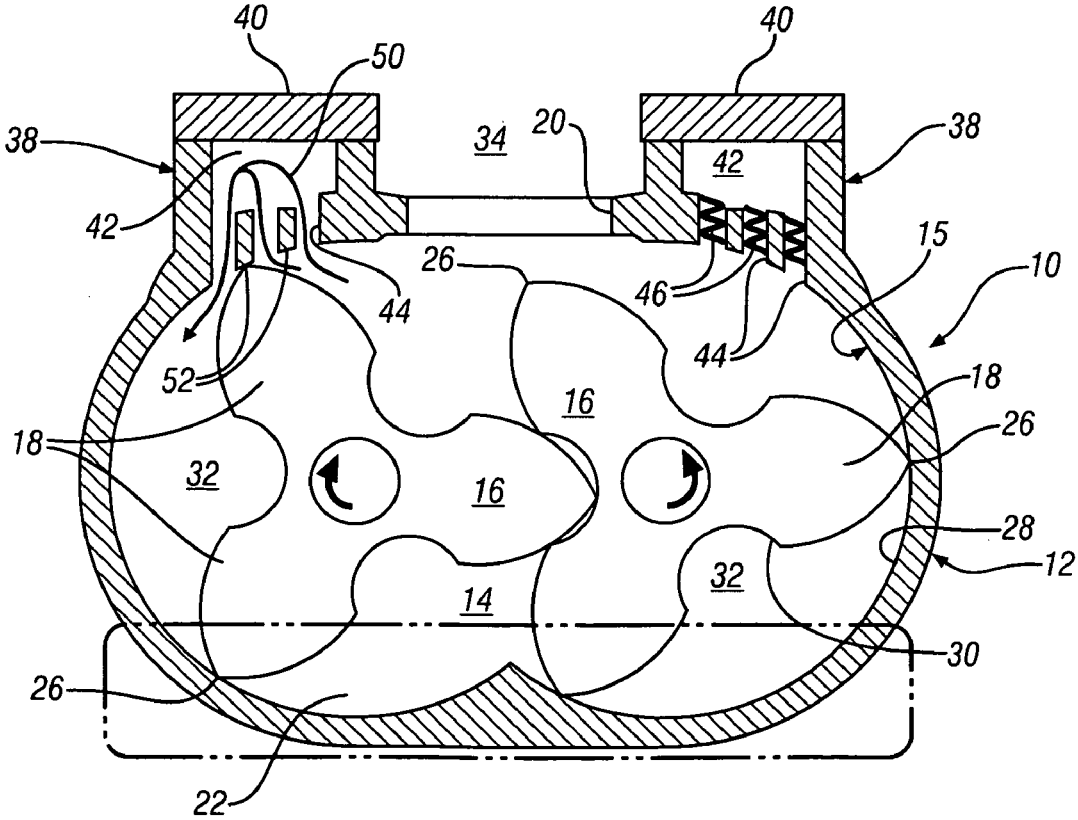
FIGS. 6 and 7 are partial sectional views of another embodiment of the supercharger of FIG. 1 taken along line 3-3.
Figure 7:
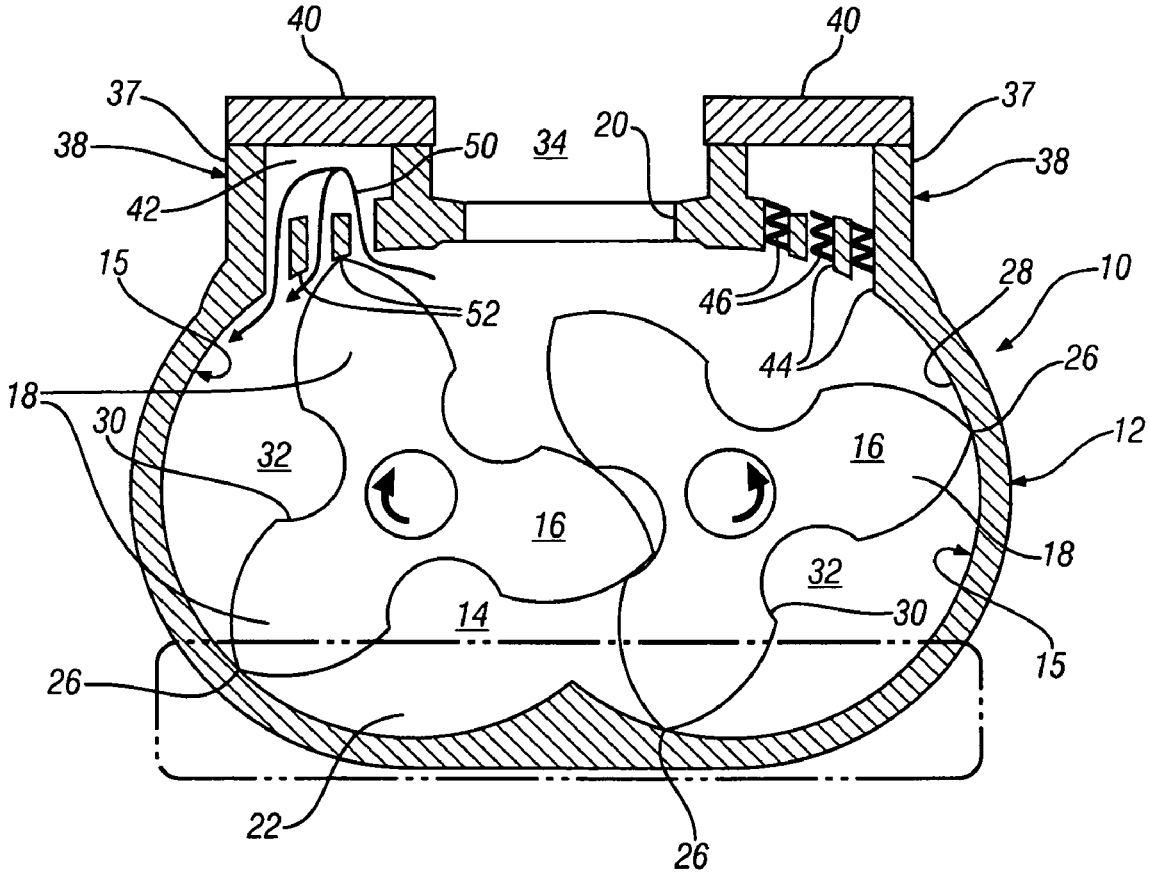

In another embodiment illustrated in FIGS. 6 and 7, the level of pressure equalization may be modified or adjusted by adding additional circumferentially spaced tuner necks or ports 44 to thereby increase the time of fluid communication between the low-pressure internal chambers 32 and the high pressure plenum 34. As a result the energy available to produce the "pop" or "report" as each internal chamber 32 opens into the high pressure plenum 34 may be adjusted.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. A supercharger comprising:

a housing having a low-pressure inlet opening, a high-pressure outlet opening and an inner cavity having a plurality of cylindrical cavity portions defined by circumferentially extending housing walls, extending within the housing and fluidly connecting the low-pressure inlet opening and the high-pressure outlet opening;

a plurality of lobed rotors, disposed for rotation in the cylindrical cavity portions, having lobes defining, in cooperation with the circumferentially extending housing walls of the cylindrical cavity portions, a plurality of low-pressure internal chambers configured to move low-pressure air from the low-pressure inlet opening to the high-pressure outlet opening of the housing during rotation of the lobed rotors;

a sound attenuator, being associated with the housing and located adjacent to the high-pressure outlet opening, defining a tuner chamber therein;

a plurality of circumferentially spaced tuner ports extending through the circumferentially extending walls of the cylindrical cavity portions to fluidly connect the tuner chamber of the sound attenuator with the inner cavity of the housing to define a Helmholtz-type resonator; and at least one land defined, by the circumferentially extending walls of the cylindrical cavity portions, extending between the circumferentially spaced tuner ports such that the high-pressure outlet opening and the plurality of low-pressure internal chambers are fluidly connected through the tuner chamber when a lobed rotor defining a low-pressure internal chamber is aligned with the land.

2. The supercharger of claim 1, wherein the circumferentially spaced tuner ports comprise at least two rows of generally parallel openings extending generally longitudinally through the circumferentially extending walls of the cylindrical cavity portions.

3. The supercharger of claim 2, wherein the at least two rows of generally parallel tuner ports are aligned with the lobed rotors.

4. The supercharger of claim 1, wherein the plurality of circumferentially spaced tuner ports comprise more than two circumferentially spaced tuner ports fluidly connecting the tuner chamber with the internal cavity of the housing.

5. The supercharger of claim 1, wherein the sound attenuator comprises sidewalls extending from the housing.

6. The supercharger of claim 1, wherein the at least one land comprises a circumferential length defined by a desired residence time of the lobed rotors thereon.

7. A supercharger comprising:

a housing having a low-pressure inlet opening, a high-pressure outlet opening and an inner cavity having a plurality of cylindrical cavity portions defined by circumferentially extending housing walls, extending within the housing and fluidly connecting the low-pressure inlet opening and the high-pressure outlet opening;

a plurality of lobed rotors, each having a plurality of radially extending lobes, being disposed for rotation in a cylindrical cavity portion;

a lobe apex extending radially from each of the radially extending lobes to terminate adjacent the circumferentially extending housing walls of the cylindrical cavity portions and defining a plurality of low-pressure internal chambers, between the radially extending lobes and the circumferentially extending walls, that are configured to move air from the low-pressure inlet to the high-pressure outlet during rotation of the lobed rotors;

a sound attenuator, being associated with the housing and located adjacent to the high-pressure outlet opening, defining a tuner chamber and having circumferentially spaced tuner ports fluidly connecting the tuner chamber with the inner cavity of the housing through the circumferentially extending walls of the cylindrical cavity portions wherein the sound attenuator and tuner ports define a Helmholtz-type resonator; and at least one land defined by the circumferentially extending walls, extending between the circumferentially spaced tuner ports to fluidly connect the high-pressure outlet opening and the low-pressure inner chambers when the lobe apexes are aligned with the at least one land to reduce the pressure differential between the high-pressure outlet opening and the low-pressure inner chambers and reduce noise generated by the supercharger.

8. The supercharger of claim 7, wherein the circumferentially spaced tuner ports comprise at least two rows of tuner ports extending generally longitudinally through the circumferentially extending housing walls of the cylindrical cavity portions.

9. The supercharger of claim 8, wherein the at least two rows of generally parallel tuner ports align with the lobe apexes.

10. The supercharger of claim 7, wherein the circumferentially spaced tuner ports comprise more than two circumferentially spaced tuner necks fluidly connecting the tuner chamber with the internal cavity of the housing.

11. The supercharger of claim 7, wherein the sound attenuator comprises sidewalls extending from the housing.

12. The supercharger of claim 7, wherein the at least one land comprises a circumferential length defined by a desired residence time of the lobe apexes thereon and a desired reduction of the pressure differential between the high-pressure outlet and the low-pressure inner chambers.

* * * * *